US009153396B2

(12) United States Patent
So et al.

(10) Patent No.: US 9,153,396 B2
(45) Date of Patent: Oct. 6, 2015

(54) KEYBOARD MODULE AND ELECTRONIC DEVICE HAVING THE SAME

(71) Applicant: Wistron Corporation, New Taipei (TW)

(72) Inventors: Kuo-Wei So, New Taipei (TW); Wen-Tai Lin, New Taipei (TW); Ying-Chen Lin, New Taipei (TW)

(73) Assignee: Wistron Corporation, New Taipei (TW)

( * ) Notice: Subject to any disclaimer, the term of this patent is extended or adjusted under 35 U.S.C. 154(b) by 180 days.

(21) Appl. No.: 14/013,037

(22) Filed: Aug. 29, 2013

(65) Prior Publication Data

US 2014/0299457 A1 Oct. 9, 2014

(30) Foreign Application Priority Data

Apr. 3, 2013 (TW) ..... 102112154 A

(51) Int. Cl.
*H01H 13/76* (2006.01)

(52) U.S. Cl.
CPC ..... *H01H 13/76* (2013.01); *H01H 2209/018* (2013.01)

(58) Field of Classification Search
CPC ..... H01H 13/76
USPC ..... 200/5 A, 5 D, 17 R, 18, 43.18, 314, 200/318.1, 333, 337, 341, 344, 345
See application file for complete search history.

(56) References Cited

U.S. PATENT DOCUMENTS

| | | | | |
|---|---|---|---|---|
| 5,590,020 | A * | 12/1996 | Sellers | 361/679.13 |
| 6,087,966 | A * | 7/2000 | Sato | 341/22 |
| 8,031,178 | B2 * | 10/2011 | Rak et al. | 345/168 |
| 2011/0170250 | A1 * | 7/2011 | Bhutani et al. | 361/679.2 |

FOREIGN PATENT DOCUMENTS

| | | |
|---|---|---|
| TW | M389337 | 9/2010 |
| TW | M406764 | 7/2011 |

OTHER PUBLICATIONS

"Office Action of Taiwan Counterpart Application," issued on Jun. 29, 2015, with English translation thereof, p. 1-p. 14, in which the listed references were cited.

* cited by examiner

*Primary Examiner* — Edwin A. Leon
*Assistant Examiner* — Iman Malakooti
(74) *Attorney, Agent, or Firm* — Jianq Chyun IP Office

(57) ABSTRACT

A keyboard module adapted to be used in an electronic device. The electronic device has a casing. The casing has a containing opening. The keyboard module contained in the containing opening includes a bottom plate, an elastic component, a cover and a key cap disposed on the elastic component. The bottom plate disposed within the casing has a circuit. The elastic component is disposed on the bottom plate or the circuit. The cover movably disposed in the containing opening is located above the bottom plate. The cover has an opening aligned to the elastic component. A portion of the key cap protrudes from the opening. Another portion of the key cap interferes with the opening, such that the key cap resists elasticity of the elastic component and moves to shorten a distance between the key cap and the bottom plate when the cover moves toward the bottom plate.

22 Claims, 8 Drawing Sheets

KEYBOARD MODULE AND ELECTRONIC DEVICE HAVING THE SAME

CROSS-REFERENCE TO RELATED APPLICATION

This application claims the priority benefit of Taiwan application serial no. 102112154, filed on Apr. 3, 2013. The entirety of the above-mentioned patent application is hereby incorporated by reference herein and made a part of this specification.

BACKGROUND

1. Field of the Application

The invention relates to an input module and an electronic device have the same, and more particularly, to a keyboard module and an electronic device having the same.

2. Description of Related Art

Since notebook computers have same functions as general desktop computers, and are designed to reduce in size and weight for being easy to carry by users, the notebook computers have become an indispensable carry-on tool for some users. As prices of the notebook computers continue to decline, some users even replace the desktop computers with the notebook computers.

In response to a thin and light trending of portable electronic device, many notebook computers are designed to have smaller thicknesses, for instance, the Ultrabooks. However, reductions in the thicknesses of the notebook computers also directly limit pressing strokes of keyboard modules thereof. For example, a pressing stroke of keys of general desktop computers is about 3.5 mm to 4.0 mm, and this pressing stroke may enable the users to type in a more smooth and comfortable manner; and in some Ultrabooks, a pressing stroke of the keys is limited to only 1.5 mm to 2.0 mm due to the reduction in the thicknesses of the bodies, and such a smaller pressing stroke may easily enable the users to type in a less smooth manner and have fatigue, thus increasing a rate of typing error.

SUMMARY OF THE APPLICATION

The invention provides a keyboard module, under a condition that an electronic device having a smaller thickness, capable of enabling a key cap to have sufficient pressing stroke and avoiding the key cap from abrasion due to body contact.

The invention provides an electronic device with a keyboard module that may provide sufficient pressing stroke under a condition that an electronic device having a smaller thickness.

The invention provides a keyboard module adapted to be used in an electronic device, the electronic device has a casing, the casing has a containing opening, the keyboard module is contained in the containing opening and includes a bottom plate, at least one elastic component, a cover and at lest one key cap. The bottom plate is disposed within the casing and has a circuit disposed thereon or therebeneath. The elastic component is disposed on the bottom plate or the circuit. The cover may be disposed movably up-and-down in the containing opening with respect to the casing and locate above the bottom plate, wherein the cover has at least one opening respectively aligned to the elastic component. Each of the key caps is respectively disposed on the corresponding elastic component, wherein at least a portion of the key cap protrudes from the corresponding opening so as to be pushed by a user, and at least another portion of the key cap interferes with the corresponding opening so as to resist elasticity of the elastic component and move to shorten a distance between the key cap and the bottom plate when the cover moves downward to the bottom plate.

The invention provides an electronic device including a first body, a second body, a keyboard module and a driving member. The first body has a casing, and the casing has a containing opening. The second body is pivoted on the first body. The keyboard module is contained in the containing opening of the casing, and includes a bottom plate, at least one elastic component, a cover and at least one key cap. The bottom plate is disposed within in the casing and has a circuit disposed thereon or therebeneath. The elastic component is disposed on the bottom plate or the circuit. The cover may be disposed movably up-and-down in the containing opening of the casing with respect to the casing and locate above the bottom plate, wherein the cover has at least one opening respectively aligned to the elastic component. Each of the key caps is respectively disposed on the corresponding elastic component, wherein at least a portion of the key cap protrudes from the corresponding opening so as to be pushed by the user, and at least another portion of the key cap interferes with the corresponding opening. The driving member is disposed on at least one of the first body and the second body, the driving member may drive the cover to move from a first position towards the bottom plate to a second position, and drive the key cap to resist elasticity of the elastic component and move to shorten a distance between the key cap and the bottom plate.

In an embodiment of the invention, the another portion of the key cap is a first flange.

In an embodiment of the invention, each of the elastic components is a rubber dome.

In an embodiment of the invention, the keyboard module further includes a plurality of scissors mechanisms respectively connected to the key cap and connected with the bottom plate.

In an embodiment of the invention, the first flange appears to be in a ring-shaped and extends along a periphery of the key cap.

In an embodiment of the invention, an inner edge of each of the openings has a second flange, and each of the first flanges is located between the corresponding second flange and the bottom plate, so as to timely interfere with the corresponding second flange to prevent the key cap from departing the opening.

In an embodiment of the invention, the second flange appears to be in a ring-shaped and surrounds the key cap.

In an embodiment of the invention, an edge of the cover has a stop portion, and the stop portion interferes with the containing opening of the casing to prevent the cover from departing the casing.

In an embodiment of the invention, the cover has a convex portion, the convex portion has an inclined surface, the driving member is a push button and slidably disposed on the casing, the push button is configured to push the convex portion along the inclined surface to drive the cover to move from the first position to the second position.

In an embodiment of the invention, the push button is slidably disposed in the casing along a first direction, the cover is adapted to move towards the bottom plate along a second direction, and the first direction is perpendicular to the second direction.

In an embodiment of the invention, the driving member is a push button and slidably disposed on the casing, the push button has a convex portion, the convex portion has an inclined surface, and the push button is configured to drive the cover to move from the first position to the second position via the inclined surface.

In an embodiment of the invention, the driving member is a bump and disposed at the second body, and when the second body is closed to the first body, the bump presses down the cover from the first position to the second position.

In an embodiment of the invention, the cover has a magnetic portion, the driving member is a magnetic member and disposed at the second body, when the second body is closed to the first body, the magnetic member is aligned to the magnetic portion, and a magnetic repulsion between the magnetic member and the magnetic portion presses down the cover from the first position to the second position.

In an embodiment of the invention, when the cover is located at the second position and the second body is closed to the first body, a display surface of the second body and each of the key caps have a spacing therebetween.

In an embodiment of the invention, when the driving member releases the cover, the cover is reset from the second position to the first position via elastic force of the elastic components.

According to the foregoing, the cover of the keyboard module of the invention is movably disposed in the casing of the electronic device, and the first flange of each of the key caps is located between the cover and the bottom plate. As such, when the second body of the electronic device is to be closed to the first body, the first flange of the key cap may be pressed down toward the bottom plate through the movement of the cover, such that the key cap and the bottom plate has a smaller distance therebetween, so as to avoid the second body from contacting the key cap and resulting in abrasion. In addition, when the user is to operate the keyboard module, the key cap and the cover may be driven to reset by the elastic force of the elastic component, so that the key cap and the bottom plate have a larger distance therebetween to provide sufficient pressing stroke for enabling the user to operate the keyboard module in a more smooth and comfortable manner. Since the keyboard module of the invention can change the distances between the key cap and the bottom plate through the movement of the cover, as described above, the key cap may has sufficient pressing stroke and may prevent the second body from contacting the key cap and resulting in abrasion under the condition that the electronic device has the smaller thickness, so that the electronic device, at the same time of complying with the design trend of being thin and lightweight, may also take into account the durability and operational comfort.

In order to make the aforementioned and other features and advantages of the present application more comprehensible, several embodiments accompanied with figures are described in detail below.

BRIEF DESCRIPTION OF THE DRAWINGS

The accompanying drawings are included to provide a further understanding of the application, and are incorporated in and constitute a part of this specification. The drawings illustrate embodiments of the application and, together with the description, serve to explain the principles of the application.

DETAILED DESCRIPTION OF DISCLOSED EMBODIMENTS

Figure 1:
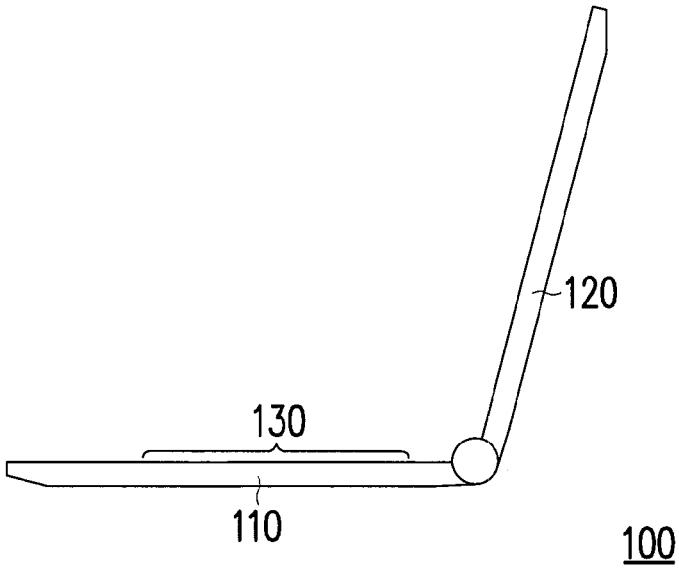
FIG. 1 is a side view illustrating an electronic device according to an embodiment of the invention.
Figure 2:
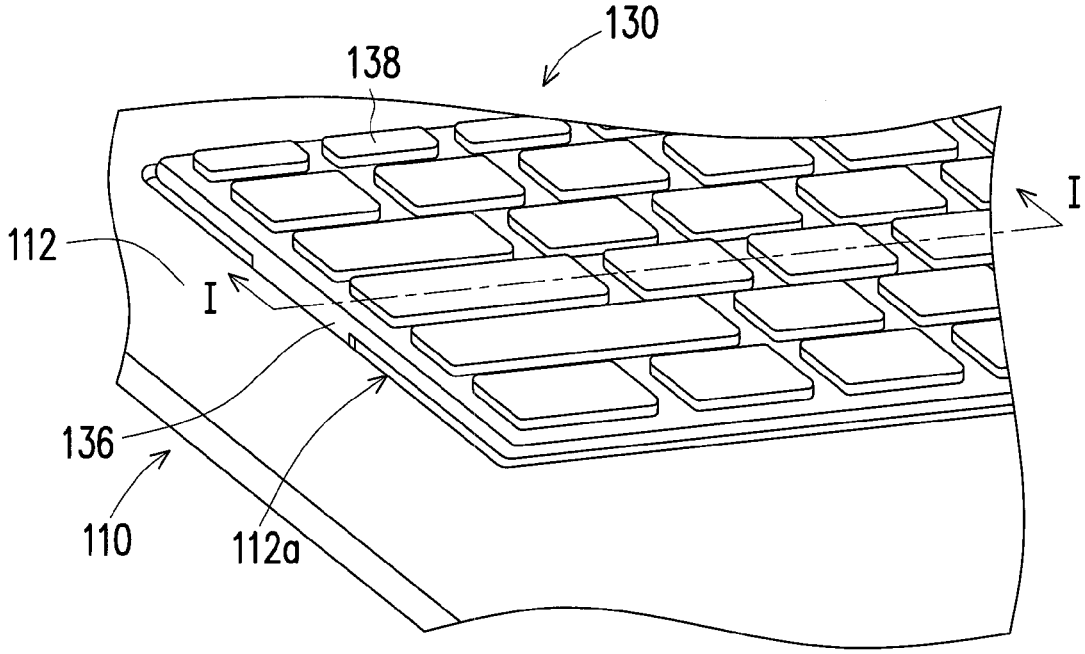
FIG. 2 is a partial perspective view illustrating a first body of FIG. 1.

FIG. 1 is a side view illustrating an electronic device according to an embodiment of the invention. FIG. 2 is a partial perspective view illustrating a first body of FIG. 1. Referring to FIG. 1 and FIG. 2, an electronic device 100 of the present embodiment, for example, is a notebook computer including first body 110, a second body 120 and a keyboard module 130. The first body 110 and the second body 120, for example, respectively are a host and a display of the notebook computer that are pivoted with each other. In other embodiments, the electronic device 100 may be other types of device with a keyboard module, but the invention is not limited thereto.

Figure 3:
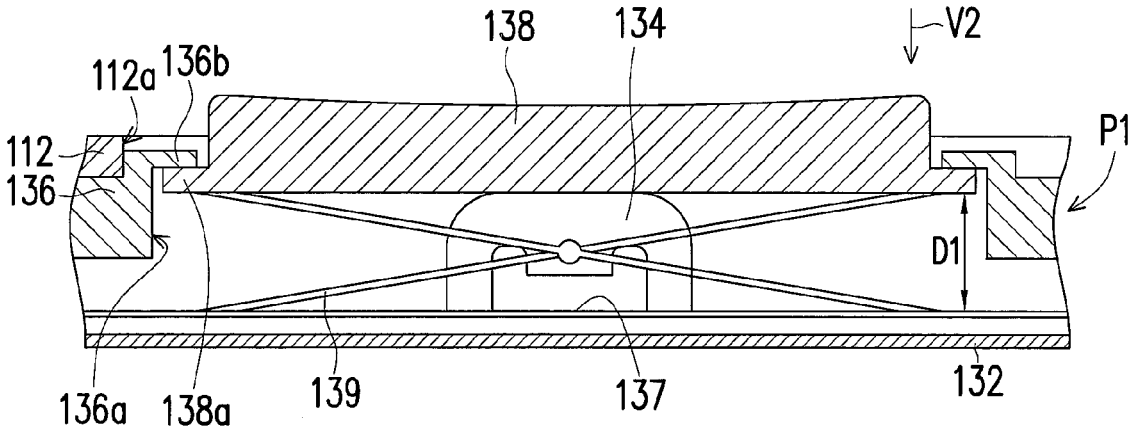
FIG. 3 is a schematic cross sectional view illustrating a keyboard module of FIG. 2 along a line I-I.
Figure 4:
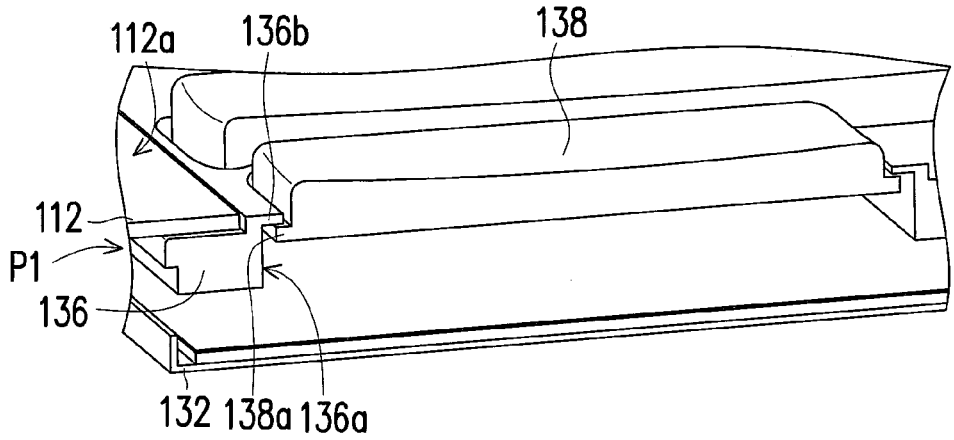
FIG. 4 is a perspective view illustrating the keyboard module of FIG. 3.

FIG. 3 is a schematic cross sectional view illustrating a keyboard module of FIG. 2 along a line I-I. FIG. 4 is a perspective view illustrating the keyboard module of FIG. 3. In order to have clearer drawing, a scissors mechanism 139 and an elastic component 134 depicted in FIG. 3 are not illustrated in FIG. 4. Referring to FIG. 2 through FIG. 4, the first body 110 has a casing 112, a top surface of the casing 112 has a large area of containing opening 112*a*, and the keyboard module 130 includes a bottom plate 132, a plurality of elastic components 134 (only one is illustrated in FIG. 3), a cover 136 and a plurality of key caps 138. The bottom plate 132 is disposed in the casing 112, a thin-film circuit 137 is laid on or below the bottom plate 132, and the elastic components 134 are then disposed on the thin-film circuit 137 or on the bottom plate 132. The cover 136 is at least in a length or width thereof greater than a corresponding length or width of the containing opening 112*a* of the casing 112, and thereby is contained in the containing opening 112*a* while covering on the bottom plate 132. The cover 136 is adapted to move up-and-down with respect to the casing 112 without departing from the containing opening 112*a*. The cover 136 has a plurality of openings 136*a*, and the openings 136*a* are aligned to the elastic components 134. The key caps 138 are disposed on the elastic components 134 and protrude out of the openings 136*a*. At least one side of each key cap 138 has a first flange 138*a* expanding outward, and each of the openings 136*a* correspondingly has a second flange 136*b* shrinking inward and thereby timely interferes with the first flange 138*a* to limit the key cap 138 from moving out of the opening 136*a*.

Figure 5:
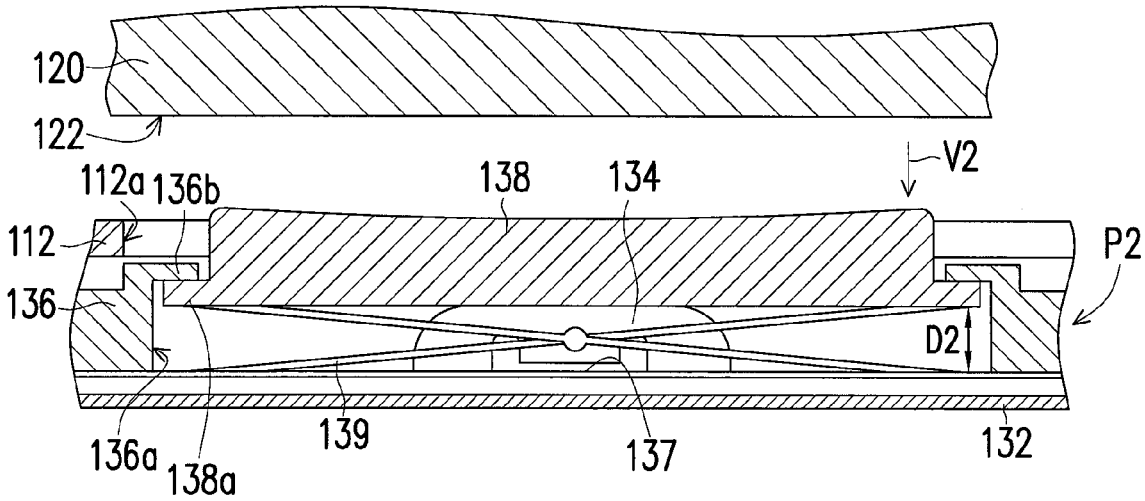
FIG. 5 is a schematic view illustrating a cover of FIG. 3 moving downwards to a bottom plate.
Figure 6:
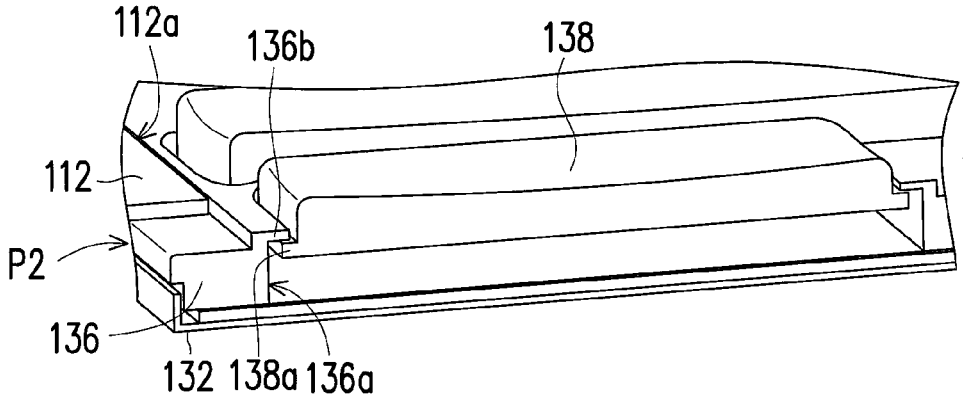
FIG. 6 is a schematic view illustrating the cover of FIG. 4 moving downwards to the bottom plate.

FIG. 5 is a schematic view illustrating a cover of FIG. 3 moving downwards to a bottom plate. FIG. 6 is a schematic view illustrating the cover of FIG. 4 moving downwards to the bottom plate. When the cover 136, as shown in FIG. 5 and FIG. 6, resists the elastic force of the elastic components 134 and moves along a second direction V2 to the bottom plate 132, the first flanges 138*a* of the key caps 138 are pressed down by the second flanges 136*b* of the cover 136, so as to shorten a distance between the key caps 138 and the bottom plate 132. For example, a distance D1 between the key caps 138 and the bottom plate 132 shown in FIG. 3 is 3.5 mm, and a distance D2 between the key caps 138 and the bottom plate 132 shown in FIG. 5 is 1.5 mm.

Figure 7:
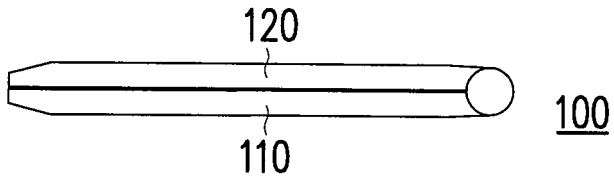
FIG. 7 is a schematic view illustrating a second body of FIG. 1 being closed to the first body.

FIG. 7 is a schematic view illustrating a second body of FIG. 1 being closed to the first body. Under the above-described configuration, when the user is to close the second body 120 of the electronic device 100 to the first body 110 as shown in FIG. 7, the key caps 138 may be pressed down toward the bottom plate 132 to the state shown in FIG. 5 and FIG. 6 through the movement of the cover 136, so that the key caps 138 and the bottom plate 132 have a smaller distance therebetween, and a display surface 122 of the second body 120 closed at the first body 110 and the key caps 138 maintain a spacing therebetween as shown in FIG. 5, so as to prevent the display surface 122 of the second body 120 from contacting the key cap 138 and resulting in abrasion. In addition, when the user is to operate the keyboard module 130, the elastic force of the elastic component 134 may drive the key caps 138 and the cover 136 to reset to the states shown in FIG. 3 and FIG. 4 by releasing the down pressing force of the cover 136, so that the key caps 138 and the bottom plate 132 have a larger distance therebetween to provide sufficient pressing stroke for enabling the user to operate the keyboard module 130 in a more smooth and comfortable manner (as if operating a general desktop computer keyboard). Since the keyboard module 130, as described in above, can change the distance between the key caps 138 and the bottom plate 132 via the up-and-down movement of the cover 136, the key caps 138 may selectively be transformed into a state with a larger pressing stroke or another state with smaller pressing stroke under the condition that the electronic device 100 has a smaller thickness. Thus, the keyboard module 130 may easily be switched to a desktop keyboard operation mode or an ultra-thin computer keyboard operation mode, and can avoid the second body 120 from having abrasion due to being in contact with the key caps 138, so that the electronic device 100, at the same time of complying with the design trend of being thin and lightweight, may also take into account the durability and operational comfort.

The elastic components 134, for example, are rubber domes, the keyboard module 130 further includes a plurality of scissors mechanisms 139 (only one is illustrated in FIG. 3 and FIG. 5), the scissors mechanism 139 are respectively connected to the key caps 138 and connected with the bottom plate 132. Same as the modes of action for scissors mechanisms and rubber domes in a conventional keyboard module, when the user presses the key cap 138, the rubber dome (elastic component 134), with an elastic deformation characteristic thereof, are compressed and contacted with the thin-film circuit 137 to generate input signals, and the scissors mechanism 139 are correspondingly actuated to enable the key cap 138 to be stably move in balance. By using the aforementioned characteristics and modes of action of the scissors mechanisms 139 and the rubber domes (elastic components 134), when the cover 136 moves from a position depicted in FIG. 3 downward to a position depicted in FIG. 5, the rubber domes (elastic components 134) are compressed to store elastic potential energy for enabling the cover 132 and the key caps 138 to reset to the position depicted in FIG. 3; and when the key caps 138 are actuated between the states depicted in FIG. 3 and FIG. 5, the scissors mechanisms 139 are correspondingly actuated to enable the key caps 138 to stably move in balance.

Figure 8:
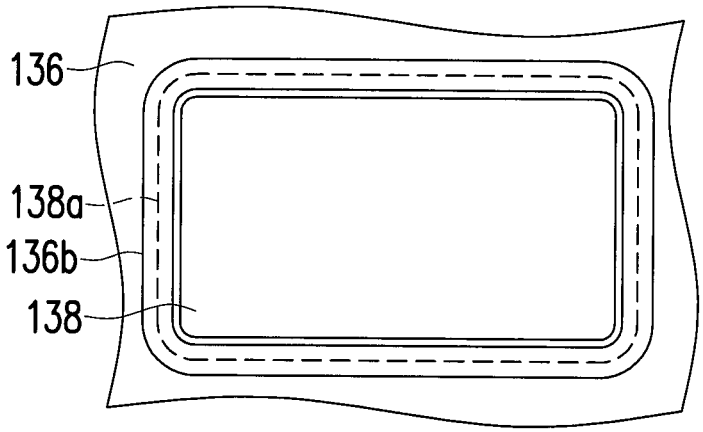
FIG. 8 is a partial top view illustrating the keyboard module of FIG. 2.

Referring to FIG. 3 through FIG. 6, in the present embodiment, an inner edge of each of the openings 136*a* may have a second flange 136*b*, and the first flange 138*a* of each of the key caps 138 is located between the second flange 136*b* and the bottom plate 132, so that the cover 136 and the key cap 138 drive each other to move via pushing abutments between the first flange 138*a* and the second flange 136*b*. The invention does not limit extended ranges of the first flange 138*a* and the second flange 136*b*. FIG. 8 is a partial top view illustrating the keyboard module of FIG. 2. For example, the first flange 138*a* may appear to be in a ring-shaped shown in FIG. 8 and extend along a periphery of the key cap 138, or only be formed on at least one side of the key cap 138. The second flange 136*b* may appear to be in a ring-shaped shown in FIG. 8 and surround the key cap 138, or only be formed on at least one side of the key cap 138.

Figure 9A:
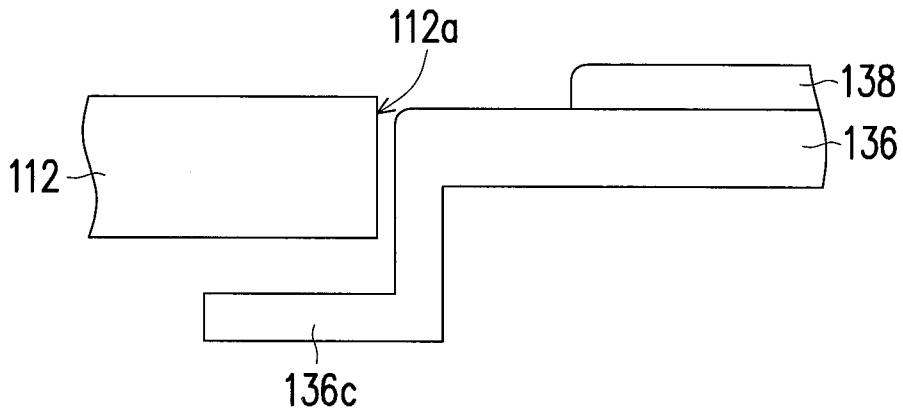
FIG. 9A and FIG. 9B are partial schematic views illustrating the cover of FIG. 2 moving in relative to a casing.
Figure 9B:
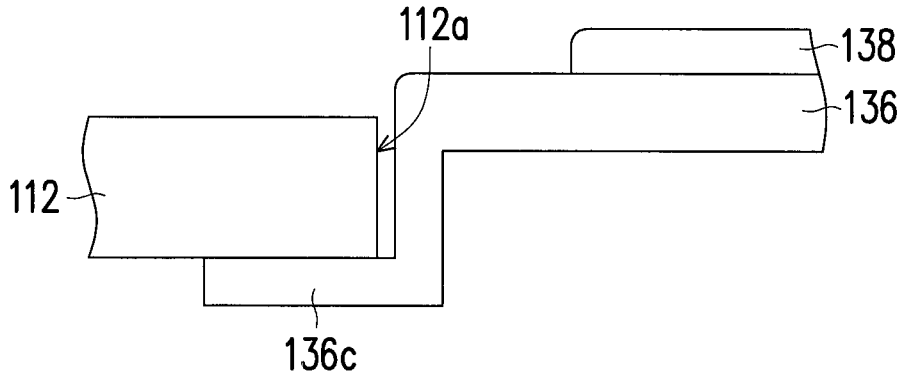

FIG. 9A and FIG. 9B are partial schematic views illustrating the cover of FIG. 2 moving in relative to a casing. Referring to FIG. 9A and FIG. 9B, in the present embodiment, the edge of the cover 136 has a stop portion 136*c*. When the cover 136 is at the positions shown in FIG. 5 and FIG. 6, the stop portion 136*c*, as depicted by FIG. 9A, is not to be in contact with the casing 112. When the cover 136 moves from the positions shown in FIG. 5 and FIG. 6 to the positions shown in FIG. 3 and FIG. 4, the stop portion 136*c*, as depicted by FIG. 9B, is to be in contact with the casing 112, so as to interfere with the cover 136 via structures of the stop portion 136*c* and the casing 112, thereby preventing the cover 136 from departing the casing 112. In other words, in the present embodiment, a lifting range of the cover 136 is limited by the design of the stop portion 136*c* of the cover 136, so that the cover 136 can actuate within a specific range while not departing from the casing 112.

Figure 10:
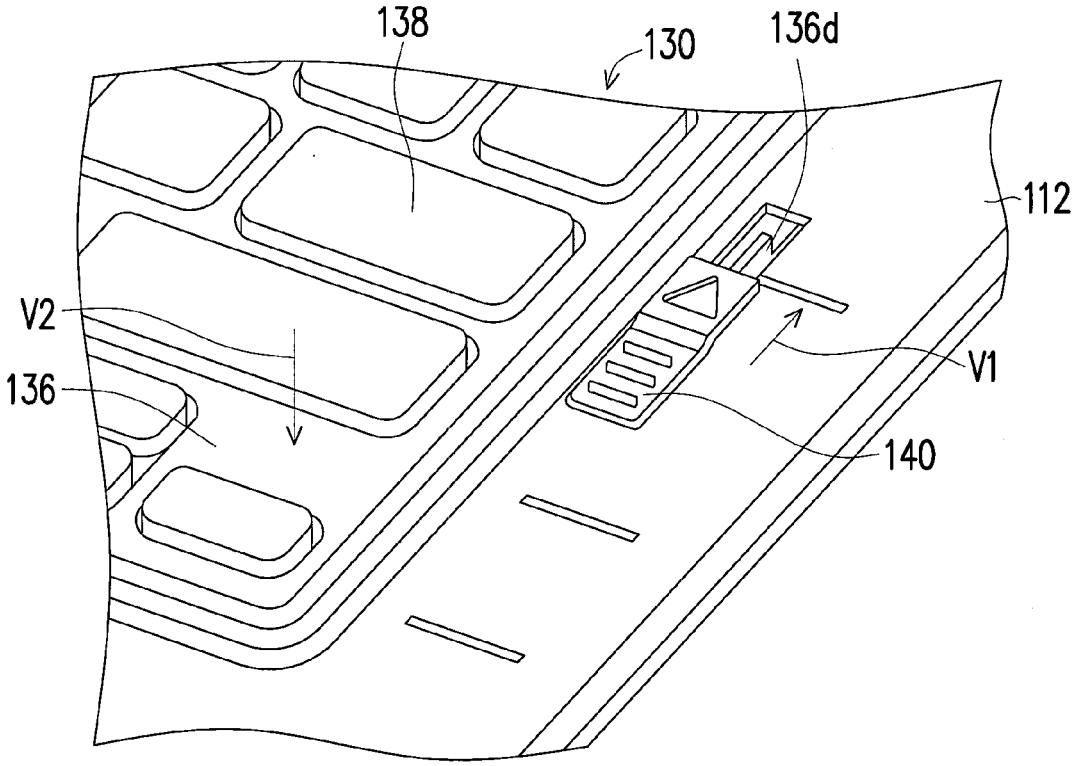
FIG. 10 is a partial perspective view illustrating the electronic device of FIG. 1.
Figure 11:
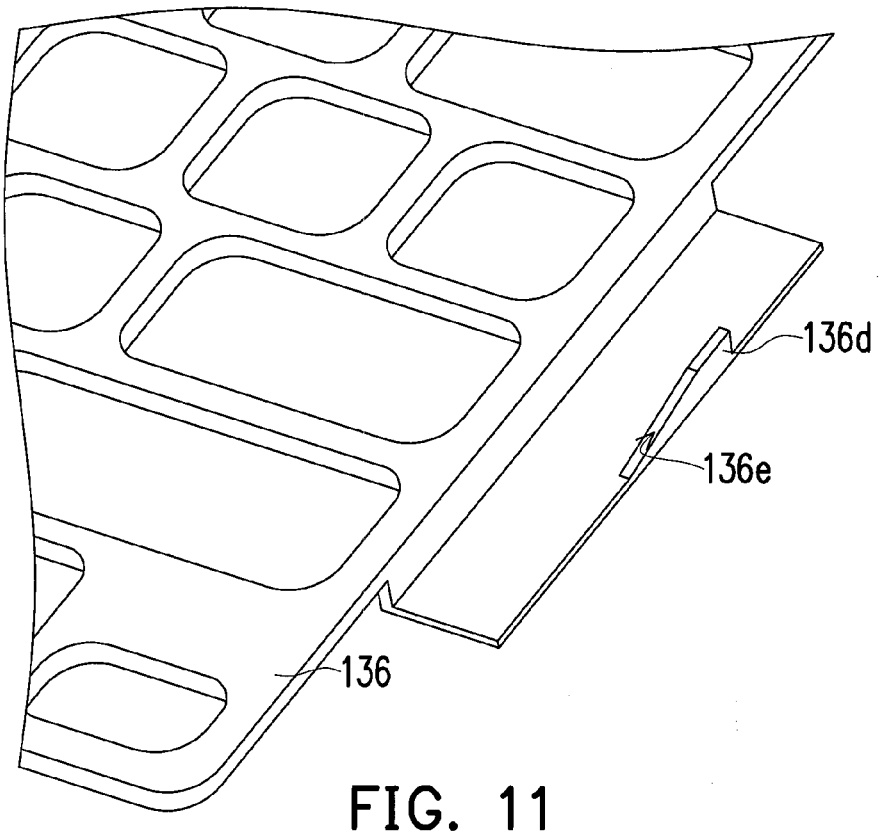
FIG. 11 is a perspective view illustrating the cover part in FIG. 10.

The following below an exemplary embodiment has been taken to specifically illustrate in detail on how to drive the cover 136 to move between the positions shown in FIGS. 3 and 4 and FIGS. 5 and 6. FIG. 10 is a partial perspective view illustrating the electronic device of FIG. 1. FIG. 11 is a perspective view illustrating the cover part in FIG. 10. Referring to FIG. 10 and FIG. 11, the electronic device 100 of the present embodiment further includes a driving member 140 being as an object for driving the cover 136 to move downward. In the present embodiment, the cover 136 correspondingly has a convex portion 136*d*, and the convex portion 136*d* has an inclined surface 136*e*. The driving member 140, for example, is a push button and may be slidably disposed at the casing 112 in correspondence to the convex portion 136*d*. The push button (driving member 140) is configured to push the convex portion 136*d* along the inclined surface 136*e* of the convex portion 136*d* to resist the elastic force of the elastic component 134 (illustrated in FIG. 3 and FIG. 5) and drive the cover 136 to move from a first position P1 shown in FIG. 3 to a second position P2 shown in FIG. 5. Before the user closes the second body 120 to the first body 110, the push button (driving member 140) may firstly be used to drive the cover 136 to move to the second position P2 in a manner as described above, such that the key cap 138 and the second body 120 closed to the first body 110 have a spacing therebetween as shown in FIG. 5, so as to prevent the display surface 122 of the second body 120 from contacting the key cap 138 and resulting in abrasion.

In detail, the push button (driving member 140) is movably disposed in the casing 112 along the first direction V1, and the cover 136 is adapted to move towards the bottom plate 132 along the second direction V2 perpendicular to the first direction V1. With the design of the inclined surface 136*e* of the convex portion 136*d*, the push button sliding along the first direction V1 can drive the cover 136 to move along the second direction V2. When the user is to reset the cover 136 and the key cap 138 from the positions depicted in FIG. 5 and FIG. 6 to the positions depicted in FIG. 3 and FIG. 4, the push button (driving member 140) may be pushed to move along a direction opposite to the first direction V1 so as to release the cover 136. Now, the cover 136 is reset from the second position P2 to the first position P1 along a direction opposite to the second direction V2 via the elastic force of the elastic component 134. One with general knowledge in the art may also know that, the convex portion 136*d* and the inclined surface 136*e* may also be modified to be disposed at the bottom of the push button (driving member 140), and then with the movement of the push button towards the first direction V1, the cover 136 is lowered by being directly pressed along the second direction V2.

The invention does not intend to limit the form of the driving member, and detail examples, accompanied with drawings, are provided in the following below.

Figure 12:
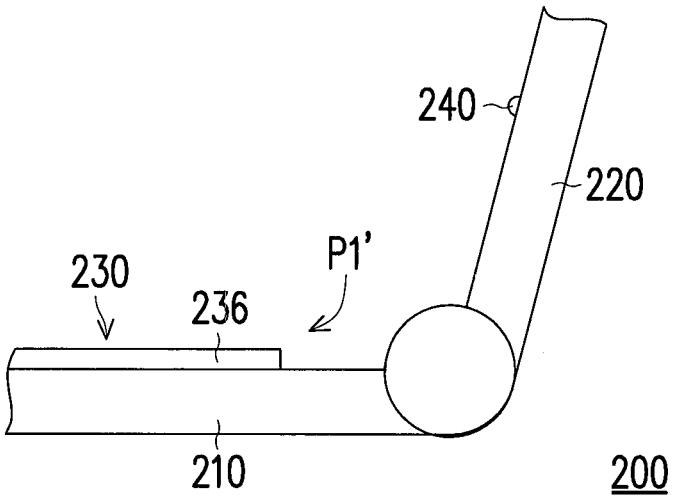
FIG. 12 is a partial side view illustrating an electronic device according to another embodiment of the invention.
Figure 13:
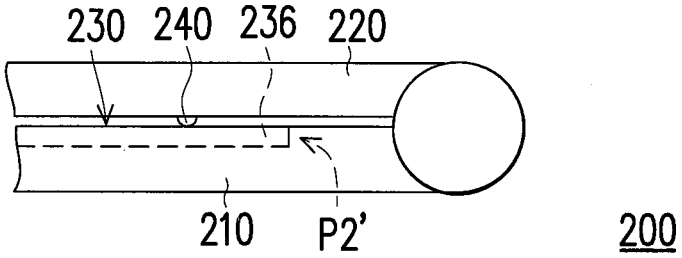
FIG. 13 is a schematic view illustrating a second body of FIG. 12 being closed to a first body.

FIG. 12 is a partial side view illustrating an electronic device according to another embodiment of the invention. FIG. 13 is a schematic view illustrating a second body of FIG. 12 being closed to a first body. Referring to FIG. 12 and FIG. 13, a configuration and a mode of action of a cover 236 of the present embodiment are similar to the configuration and the mode of action of the cover 136, and thus are not to be repeated herein. A difference between an electronic device 200 of the present embodiment and the aforementioned electronic device 100 is that, a driving member 240 is a bump and disposed at a second body 220. When the user is to close the second body 220 to a first body 210 as depicted in FIG. 13, the bump (driving member 240) presses down a cover 236 of a keyboard module 230 from a first position P1' (equivalent to the first position P1 shown in FIG. 3 and FIG. 4) to a second position P2' (equivalent to the second position P2 shown in FIG. 5 and FIG. 6) with the closing of the second body 220, so as to prevent the second body 220 from contacting the keyboard module 230 and resulting in abrasion.

Figure 14:
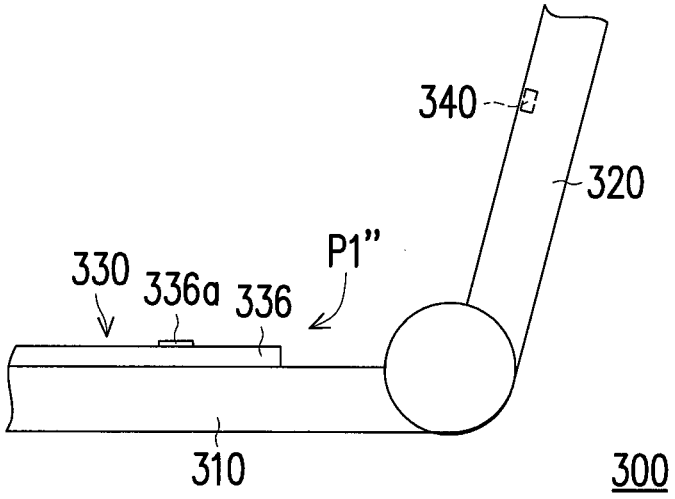
FIG. 14 is a partial side view illustrating an electronic device according to yet another embodiment of the invention.
Figure 15:
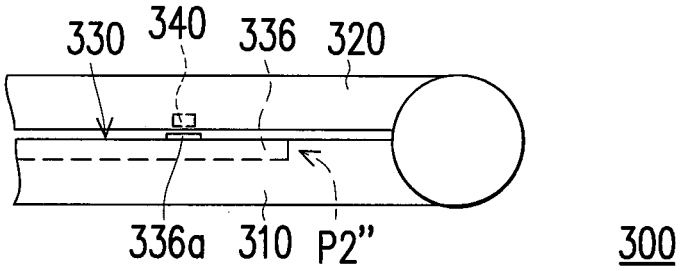
FIG. 15 is a schematic view illustrating a second body of FIG. 14 being closed to a first body.

FIG. 14 is a partial side view illustrating an electronic device according to yet another embodiment of the invention. FIG. 15 is a schematic view illustrating a second body of FIG. 14 being closed to a first body. A configuration and a mode of action of a cover 336 of the present embodiment are similar to the configuration and the mode of action of the cover 136, and thus are not to be repeated herein. Differences between an electronic device 300 of the present embodiment and the aforementioned electronic device 100 are that, the cover 336 has a magnetic portion 336*a*, and a driving member 340 is a magnetic member and disposed at a second body 320. The magnetic portion 336*a* and the magnetic member (driving member 340), for example, are both permanent magnets. When the user is to close the second body 320 to a first body 310 as depicted in FIG. 15, the magnetic member (driving member 340) is to be aligned to the magnetic portion 336*a* with the closing of the second body 320, and a magnetic repulsion between the magnetic member (driving member 340) and the magnetic portion 336*a* presses down the cover 336 of a keyboard module 330 from a first position P1" (equivalent to the first position P1 shown in FIG. 3 and FIG. 4) to a second position P2" (equivalent to the second position P2 shown in FIG. 5 and FIG. 6), so as to prevent the second body 320 from contacting the keyboard module 330 and resulting in abrasion.

In summary, the cover of the keyboard module of the invention may be movably disposed at the casing of the electronic device, and the first flange of each of the key caps is located between the cover and the bottom plate. As such, when the user is to close the second body of the electronic device to the first body, the key cap is pressed down towards the bottom plate through the movement of the cover, such that the key cap and the bottom plate have a smaller distance therebetween, so as to prevent the second body from contacting the key cap of the keyboard module and resulting in abrasion. In addition, when the user is to operate the keyboard module, the cover may be released to drive the key cap and the cover to reset via the elastic force of the elastic component, so that the key cap and the bottom plate have larger distance therebetween for providing sufficient pressing stroke to enable the user to operate the keyboard module in a more smooth and comfortable manner. Since the keyboard module of the invention can change the distance between the key cap and the bottom plate through the movement of the cover, as described above, the key cap may have sufficient pressing stroke under the condition that the electronic device has the smaller thickness, so that the electronic device, at the same time of complying with the design trend of being thin and lightweight, may also take into account the durability and operational comfort.

It will be apparent to those skilled in the art that various modifications and variations can be made to the structure of the application without departing from the scope or spirit of the application. In view of the foregoing, it is intended that the application cover modifications and variations of this application provided they fall within the scope of the following claims and their equivalents.

What is claimed is:

1. A keyboard module adapted to be used in an electronic device, the electronic device having a casing, the casing having a containing opening, the keyboard module contained in the containing opening and comprising:

a bottom plate disposed within the casing, and having a circuit disposed thereon or therebeneath;

at least one elastic component disposed on the bottom plate or the circuit;

a cover disposed movably up-and-down in the containing opening with respect to the casing and located above the bottom plate, wherein the cover has at least one opening respectively aligned to the elastic component; and at least one key cap respectively disposed on the corresponding elastic component, wherein at least a portion of the key cap protrudes from the corresponding opening so as to be pushed by a user, and at least another portion of the key cap interferes with the corresponding opening so as to drive the key cap to resist elasticity of the elastic component and move to shorten a distance between the key cap and the bottom plate when the cover moves downward to the bottom plate, wherein the cover is reset via elastic force of the elastic component.

2. The keyboard module as recited in claim 1, wherein the another portion of the key cap is a first flange.

3. The keyboard module as recited in claim 1, wherein each of the elastic components is a rubber dome.

4. The keyboard module as recited in claim 1 further comprising a plurality of scissors mechanisms respectively connected to the key caps and connected with the bottom plate.

5. The keyboard module as recited in claim 2, wherein the first flange appears to be in a ring-shaped and extends along a periphery of the key cap.

6. The keyboard module as recited in claim 2, wherein an inner edge of each of the openings has a second flange, and each of the first flanges is located between the corresponding second flange and the bottom plate, so as to timely interfere with the corresponding second flange to prevent the key cap from departing the opening.

7. The keyboard module as recited in claim 6, wherein the second flange appears to be in a ring-shaped and surrounds the key cap.

8. The keyboard module as recited in claim 1, wherein an edge of the cover has a stop portion, and the stop portion interferes with the containing opening of the casing to prevent the cover from departing the casing.

9. An electronic device comprising:

a first body having a casing, the casing having a containing opening;

a second body pivoted on the first body;

a keyboard module contained in the containing opening of the casing, comprising:

a bottom plate disposed within the casing and having a circuit disposed thereon or therebeneath;

at least one elastic component disposed on the bottom plate or the circuit;

a cover disposed movably up-and-down in the containing opening of the casing with respect to the casing and located above the bottom plate, wherein the cover has at least one opening respectively aligned to the elastic component; and at least one key cap respectively disposed on the corresponding elastic component, wherein at least a portion of the key cap protrudes from the corresponding opening so as to be pushed by a user, and at least another portion of the key cap interferes with the corresponding opening; and a driving member disposed on at least one of the first body and the second body, wherein the driving member is adapted to drive the cover to move from a first position towards the bottom plate to a second position, and drive the key cap to resist elasticity of the elastic component and move to shorten a distance between the key cap and the bottom plat;

wherein when the driving member releases the cover, the cover is reset from the second position to the first position via elastic force of the elastic components.

10. The electronic device as recited in claim 9, wherein the another portion of the key cap is a first flange.

11. The electronic device as recited in claim 9, wherein each of the elastic components is a rubber dome.

12. The electronic device as recited in claim 9, wherein the keyboard module further comprises a plurality of scissors mechanisms respectively connected the key cap and connected with the bottom plate.

13. The electronic device as recited in claim 10, wherein the first flange appears to be in a ring-shaped and extends along a periphery of the key cap.

14. The electronic device as recited in claim 10, wherein an inner edge of each of the openings has a second flange, each of the first flanges is located between the corresponding second flange and the bottom plate, so as to timely interfere with the corresponding second flange to prevent the key cap from departing the opening.

15. The electronic device as recited in claim 14, wherein the second flange appears to be in a ring-shaped and surrounds the key cap.

16. The electronic device as recited in claim 9, wherein an edge of the cover has a stop portion, and the stop portion interferes with the containing opening of the casing to prevent the cover from departing the casing.

17. The electronic device as recited in claim 9, wherein the cover has a convex portion, the convex portion has an inclined surface, the driving member is a push button and slidably disposed on the casing, and the push button is configured to push the convex portion along the inclined surface, so as to drive the cover to move from the first position to the second position.

18. The electronic device as recited in claim 17, wherein the push button is slidably disposed on the casing along a first direction, the cover is adapted to move towards the bottom plate along a second direction, and the first direction is perpendicular to the second direction.

19. The electronic device as recited in claim 9, wherein the driving member is a push button and slidably disposed on the casing, the push button has a convex portion, the convex portion has an inclined surface, the push button is configured to push the cover to move via the inclined surface, so as to drive the cover to move from the first position to the second position.

20. The electronic device as recited in claim 9, wherein the driving member is a bump and disposed at the second body, and when the second body is closed to the first body, the bump presses down the cover from the first position to the second position.

21. The electronic device as recited in claim 9, wherein the cover has a magnetic portion, the driving member is a magnetic member and disposed at the second body, when the second body is closed to the first body, the magnetic member is aligned to the magnetic portion, and a magnetic repulsion between the magnetic member and the magnetic portion presses down the cover from the first position to the second position.

22. The electronic device as recited in claim 9, wherein when the cover is located at the second position and the second body is closed to the first body, a display surface of the second body and each of the key caps have a spacing therebetween.

* * * * *